US006799728B2

(12) United States Patent
Yamauchi

(10) Patent No.: US 6,799,728 B2
(45) Date of Patent: Oct. 5, 2004

(54) METHOD FOR SPRAY-COATING AQUEOUS PAINT

(75) Inventor: Masahiro Yamauchi, Osaka-fu (JP)

(73) Assignee: Nippon Paint Co., Ltd., Osaka-fu (JP)

( * ) Notice: Subject to any disclaimer, the term of this patent is extended or adjusted under 35 U.S.C. 154(b) by 199 days.

(21) Appl. No.: 10/067,844

(22) Filed: Feb. 8, 2002

(65) Prior Publication Data

US 2002/0192388 A1 Dec. 19, 2002

(30) Foreign Application Priority Data

Feb. 9, 2001 (JP) ..... 2001-034105

(51) Int. Cl.[7] ..... B05B 17/04

(52) U.S. Cl. ..... 239/13; 239/1; 239/128; 239/132; 239/132.1; 239/133; 239/135

(58) Field of Search ..... 239/128, 132, 239/132.1, 132.3, 133, 135, DIG. 14, 1, 13

(56) References Cited

U.S. PATENT DOCUMENTS 3,857,511 A * 12/1974 Govindan ..... 239/11
4,132,357 A * 1/1979 Blackinton ..... 239/11
5,993,913 A * 11/1999 Rosenberger et al. ..... 239/419
6,045,875 A * 4/2000 Ishino ..... 239/427.5

* cited by examiner

*Primary Examiner*—Robin O. Evans
(74) *Attorney, Agent, or Firm*—Wenderoth, Lind & Ponack, L.L.P.

(57) ABSTRACT

Disclosed is a method for spray-coating aqueous paint, characterized in that a portion of a spray gun is cooled or heated to adjust a temperature of aqueous paint passing through the spray gun to a suitable range within allowable volume absolute humidity during spray coating, so that the temperature of aqueous paint maintains in optimum range in accordance with change of both surrounding temperatures and surrounding humidities during spray coating.

4 Claims, 1 Drawing Sheet

METHOD FOR SPRAY-COATING AQUEOUS PAINT

FIELD OF THE INVENTION

The present invention relates to a method for spray-coating aqueous paint, whereby coating defects raised by change in surrounding conditions, such as temperature and humidity are avoided.

DEFINITION OF TERMS USED HEREIN

The term "allowable volume absolute humidity" in a unit of $g/m^3$, means a difference between saturated volume absolute humidity and absolute humidity at a given temperature. The saturated volume absolute humidity means a maximum amount of water contained in gaseous form in the air of a unit volume.

BACKGROUND OF THE INVENTION

Aqueous paint (water-borne paint) mainly contains water as a solvent. Therefore, aqueous paint is not hazardous to human body in coating conditions, and can easily treat when compared to solvent based paint (solvent-borne paint). Aqueous paint is advantageously recycled by collecting an over-spray paint that has not been coated, with an aqueous solvent, on an article to be coated, filtering and concentrating the collected paint, and adjusting the paint formulation for recycle use. The recycling of aqueous paint reduces paint waste and saves resources. Therefore, aqueous paint has been widely used for industrial coating, such as automotive and home electric apparatus coating.

In a coating line for automotive bodies, coating aqueous paint is generally conducted by spray-coating; wherein the aqueous paint is sprayed onto an article employing a spray gun, to form a thin and uniform film coating on the article.

Aqueous paint, when spray-coated, is deposited onto an article, allowing evaporation of some of the solvent (i.e. water in the air), to result in forming a wet coating. The wet coating is then dried or baked to form a dry coating on the article.

Appearance of the dry coating significantly depends on both the amount of water evaporated from the aqueous paint during spray-coating and setting, which is the time between spray-coating and drying or baking, and the flowability (i.e. viscosity) of the wet coating. The amount of water evaporated generally depends on the coating conditions, such as temperature and humidity. For example, when the coating temperature is too low and humidity is too high, evaporation of water from aqueous paint is so slow that viscosity of the wet coating deposited on the article is lowered, and flowability is elevated, resulting in "sagging" of the coated film. In addition, when the coating temperature is too high and the humidity is too low, evaporation of water from the aqueous paint is so accelerated that the wet coating becomes very viscous, with poor flowability, resulting in "surface blemishes" of the coated film.

It is also known in the art that the viscosity of a wet coating increases as the non-volatile content of aqueous paint increases, and that the non-volatile content of wet coating changes degree of water evaporation from aqueous paint during coating. In order to prevent surface defects, such as sagging or surface blemishes, the viscosity of a wet coating should be controlled not only by adjusting the amount of water evaporated from the aqueous paint indirectly, but also by adjusting the non-volatile content of the aqueous paint directly, in accordance with changing coating conditions, such as temperature and humidity.

Coating conditions of aqueous paint in the prior art are generally controlled to a surrounding temperature of 15 to 35° C. and a relative humidity of 60 to 90%. However, it is considered very difficult and expensive to optimize theh non-volatile content of aqueous paint with a change of coating conditions, because coating conditions actually change based upon the time of day (morning, day time or evening) and with the seasons. Even if non-volatile content of aqueous paint is optimized, it should be utilized in coating conditions where the amount of water evaporated is constant. This may be performed only in facilities where temperature and humidity are kept constant and where a hood is used to cover both the portion introducing the aqueous paint into a spray gun and the portion coating the paint on articles. These facilities seem cost consuming.

OBJECT OF THE INVENTION

The present invention is to provide a method for spray-coating aqueous paint wherein the non-volatile content of aqueous paint is adjusted in accordance with a change of coating conditions (temperature and humidity), and wherein the amount of water evaporated from the aqueous paint is controlled, without complicated and expensive operations; resulting in the formation of coatings having good appearance, without surface defects, such as sagging and surface blemishes. ?

SUMMARY OF THE INVENTION

As the result of studying a relation between paint viscosity and non-volatile content (NV) in paint, the present inventors have found that excellent appearance would be obtained by controlling a temperature of aqueous paint (paint temperature) during spray coating such as a difference ($\Delta NV=NV_2-NV_1$) between $NV(NV_1)$ of aqueous paint during spray coating and $NV(NV_2)$ of wet coating after one minute setting is within the range of 3 to 8%.

The $NV_2$ for wet coating also changes in accordance with change of surrounding temperature and humidity. For example, $NV_2$ becomes higher at a condition of high temperature and low humidity, in comparison with a condition of low temperature and high humidity, because wet coating is dried much more. The change of $NV_2$ in turn changes $\Delta NV$. In view of the above, the present inventors have now introduced concept of allowable volume absolute humidity that is calculated from surrounding temperature and humidity, in order to adjust paint temperature, whereby $\Delta NV$ is adjusted within preferred ranges (3 to 8%). The introduction of allowable volume absolute humidity reduces parameters from two, i.e. temperature and humidity, to one.

Accordingly, the present invention provides a method for spray-coating aqueous paint, characterized in that a portion of a spray gun, especially a gun tip, is cooled or heated to adjust a temperature of aqueous paint passing through the spray gun to a suitable range within allowable volume absolute humidity during spray coating, so that the temperature of aqueous paint maintains in optimum range in accordance with change of both surrounding temperatures and surrounding humidities during spray coating.

In addition, the present invention provides that the temperature of paint is controlled within a range satisfying the following equations:

$$aX^2+bX+c \leqq Y \leqq dX^2+eX+f$$

$$10 \leqq X \leqq 80$$

$$1 \leqq Y \leqq 15$$

wherein X shows a temperature of aqueous paint, Y shows an allowable volume absolute humidity, and a, b, c, d, e and f are coefficients that are specific to the aqueous paint employed and experimentally obtained.

DETAILED DESCRIPTION OF THE INVENTION

Figure 1:
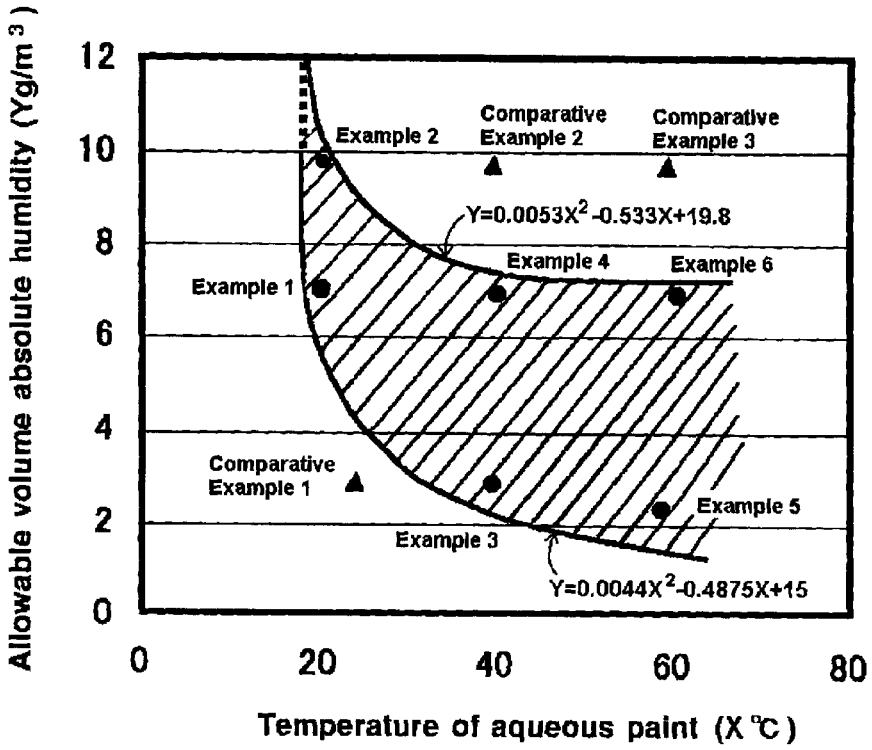
FIG. 1 is a graph that shows a preferable aqueous paint temperature range against allowable volume absolute humidity (g/m$^3$) obtained from temperature and humidity in coating conditions.

The present invention is characterized in that a temperature of aqueous paint (aqueous paint temperature) is adjusted at spray coating. The term "at spray coating" means not only just before actually spray-coating aqueous paint but includes before introducing aqueous paint into the spray gun for spray-coating. The term "paint temperature" means a temperature of aqueous paint at a time of erupting from a spray gun tip.

According to the method of the present invention, the temperature of aqueous paint is controlled within an optimum range in accordance with change of both surrounding temperatures and surrounding humidities during spray coating. The surrounding temperatures (°C.) and surrounding relative humidities (%) are firstly determined during spray-coating. The determination of temperature and humidity can be conducted by conventional methods and devices.

The surrounding temperature and saturated vapor pressure of the solvent (i.e. water) at the temperature can be calculated to obtain saturated volume absolute humidity (g/m$^3$) which is then distracted from absolute humidity at the temperature to obtain allowable volume absolute humidity Y (g/m$^3$).

According to the present invention, the allowable volume absolute humidity Y is adjusted to fall within a preferred range by controlling an aqueous paint temperature X. Particularly, the paint temperature X is controlled within a range satisfying the following equations:

$$aX^2+bX+c \leqq Y \leqq dX^2+eX+f$$

$$10 \leqq X \leqq 80$$

$$1 \leqq Y \leqq 15$$

wherein X shows a temperature of aqueous paint, Y shows an allowable volume absolute humidity, and a, b, c, d, e and f are coefficients that are specific to the aqueous paint employed and experimentally obtained. X is preferably within the range of 20 to 60° C.

For example, when the aqueous paint is a dispersion-type aqueous paint, the a, b, c, d, e and f are made a=0.0044, b=−0.4875, c=15, d=0.0053, e=−0.533 and f=19.8 to determine a preferred temperature X based on the allowable volume absolute humidity Y.

More concretely, the preferred aqueous paint temperature range is shown as oblique lines in FIG. 1 which shows a graph between allowable volume absolute humidity (g/m$^3$) and temperature of aqueous paint. FIG. 1 is for a dispersion-type aqueous paint.

According to the present invention, the paint temperature of aqueous paint is controlled and an evaporating amount of water between spray coating and formation of wet coating is always within optimum range even if coating conditions, such as temperature and humidity, change with time and season. As the result, coating defects, such as sagging and surface blemish, may be significantly prevented and excellent surface appearance can be obtained.

Adjustment of paint temperature can be conducted by controlling a paint storage tank or a paint providing tank to constant temperatures, but temperature-control of whole of the tank is structurally large and complicated and cost-consuming. Since whole of paint contained in the tank has to be temperature-controlled, heat load applied to paint becomes very large and even changes paint quality. Accordingly, in the present invention, it is preferred to temperature-control a potion of a spray gun, especially a spray gun tip. Temperature-control of a portion of a spray gun, especially a spray gun tip is very easy and can be conducted by a smaller device, with lower energy loss. Temperature control only at the gun tip is not so complicated and is conducted swiftly with time and condition.

In order to heat or cool at least a portion of the spray gun, especially the spray gun tip, any means known to the art can be employed. For example, a heating jacket or cooler with a conventional temperature controller (e.g. a thermostat) is equipped with the gun, or a water or air having controlled temperature is provided to the gun tip through a tube having high thermal conductivity.

EXAMPLES

The present invention is illustrated in details by the following Examples and Comparative Examples, which are not to be construed as limiting the present invention to their details.

Examples 1 to 6 and Comparative Examples 1 to 3

In Examples and Comparative Examples, the following are used as aqueous paint, a coating machine and an article to be coated:

- Aqueous paint: ADE RECYCLE F-2000 TMS Black (available from Nippon Paint Co., Ltd.
- Spray coater: Wider 88 (available from Anest Iwata Co. Ltd.)
- Article to be coated: 0.8 mm steel panel (SPCC-SD untreated panel)

In Examples 1 to 6, surrounding temperature and relative humidity before spray-coating were determined by temperature and humidity detectors each known to the art, from which each allowable volume absolute humidity Y was obtained. A paint temperature X was calculated from the equation using the allowable volume absolute humidity Y. In order to put the present invention to practice use, aqueous paint provided to the portion of the spray gun is temperature-controlled within the optimum temperature range in a short period of time before spray-coating in response to coating conditions changing with time. Therefore, information obtained from the temperature and humidity detectors is input into a computer and calculated from the above mentioned equation to obtain optimum paint temperature and a temperature of the spray gun tip was adjusted by the computer system from the data input in the computer. Spray coating was conducted using the temperature controlled spray gun onto the article to be coated and dried at 60° C. for 20 minutes. In case where the paint temperature of aqueous paint was already with the optimum paint temperature range, no further temperature control had not be conducted and sprayed neatly. Surface appearance of the coatings was visually evaluated and the results are shown in Table 1.

In Comparative Examples, the paint temperature X was set of the optimum range, although the surrounding temperature and humidity were determined. Spray coating and surface evaluation were conducted as generally described in Examples 1 to 6. The results are also shown in

TABLE 1

| | Examples | | | | | | Comparative Examples | | |
|---|---|---|---|---|---|---|---|---|---|
| Coating conditions | 1 | 2 | 3 | 4 | 5 | 6 | 1 | 2 | 3 |
| Surrounding temperature (° C.) | 25 | 25 | 25 | 25 | 25 | 25 | 25 | 25 | 25 |
| Relative humidity (%) | 70 | 57 | 88 | 70 | 90 | 70 | 88 | 57 | 57 |
| Allowable volume absolute humidity Y ($g/m^3$) | 7.0 | 9.8 | 2.8 | 7.0 | 2.6 | 7.0 | 2.8 | 9.8 | 9.8 |
| Aqueous paint temperature X (° C.) | 20 | 20 | 40 | 40 | 60 | 60 | 25 | 40 | 60 |
| Surface appearance | ○ | ○ | ○ | ○ | ○ | ○ | $X^1$ | $X^2$ | $X^2$ |

○: No surface defects
$X^1$: Sagging was observed.
$X^2$: Surface blemish was observed.

As is apparent from the above Table 1, the coatings obtained in Examples 1 to 6 in which aqueous paint temperature was adjusted within the range of optimum range showed very good surface appearance. On the other hand, those of Comparative Examples showed poor surface appearance and indicated sagging or surface blemish.

What is claimed is

1. A method for spray-coating aqueous paint, characterized in that a portion of a spray gun is cooled or heated to adjust a temperature of aqueous paint passing through the spray gun to a suitable range within allowable volume absolute humidity during spray coating, and a difference of non-volatile contents ($\Delta NV=NV_2-NV_1$) between a non-volatile content ($NV_1$) of aqueous paint during spray coating and a non-volatile content ($NV_2$) of wet coating after one minute setting is controlled to a suitable range, so that the temperature of aqueous paint maintains in optimum range in accordance with change of both surrounding temperatures and surrounding humidities during spray coating.

2. The method according to claim 1 wherein the spray gun is cooled or heated at a gun tip.

3. The method according to claim 1 wherein the temperature of paint is controlled within a range satisfying the following equations:

$$aX^2+bX+c \leqq Y \leqq dX^2+eX+f$$

$$10 \leqq X \leqq 80$$

$$1 \leqq Y \leqq 15$$

wherein X shows an optimum temperature of aqueous paint, Y shows an allowable volume absolute humidity, and a, b, c, d, e and fare coefficients that are specific to the aqueous paint employed and experimentally obtained.

4. The method according to claim 1 wherein the $\Delta NV=NV_2-NV_1$ is adjusted within the range of 3 to 8%.

* * * * *